US005094727A

United States Patent [19]

Schwarz et al.

[11] Patent Number: 5,094,727

[45] Date of Patent: Mar. 10, 1992

[54] ELECTROLYTE FOR PRODUCING CONVERSION COATINGS

[75] Inventors: Thomas Schwarz, Chemnitz; Ullrich Bayer, Jena; Kerstin Haupt, Jena; Juergen Schmidt, Jena; Thomas Furche, Jena, all of Fed. Rep. of Germany

[73] Assignee: Jenoptik Jena GmbH, Jena, Fed. Rep. of Germany

[21] Appl. No.: 691,629

[22] Filed: Apr. 25, 1991

[30] Foreign Application Priority Data

Jun. 14, 1990 [DD] German Democratic Rep. ..... 3416378

[51] Int. Cl.[5] ..... C25D 11/02; C25D 11/06

[52] U.S. Cl. ..... 205/322; 205/327

[58] Field of Search ..... 204/56.1, 58

[56] References Cited

U.S. PATENT DOCUMENTS 4,869,789 9/1989 Kurze ..... 204/56.1

*Primary Examiner*—T. M. Tufariello

*Attorney, Agent, or Firm*—Jordan and Hamburg

[57] ABSTRACT

By means of an electrolyte free of ammonia, cyanide, and fluoride, hence low in harmful substances and inoffensive to the environment, optically black coatings having a thickness of less than 10 microns and substantially equal optical absorption and thermal emission capability can be produced on light metals or alloys thereof by spark discharge anodizing. In comparison with prior art conversion coatings obtained by spark discharge anodizing, the coatings produced with this electrolyte have a substantially lower roughness of this electrolyte in spark discharge anodizing provides an alternative mode of coating particularly for structural components or subassemblies of complicated shapes having greater requirements for accuracy to gauge.

4 Claims, No Drawings

ELECTROLYTE FOR PRODUCING CONVERSION COATINGS

This invention relates to the formation of conversion coatings, and more particularly to an electrolyte of the type used for producing uniformly thin, matte black conversion coatings as functional surfaces of structural components or subassemblies made of light-metal materials or alloys thereof by the spark discharge anodizing method. In their application, such electrolytes represent an alternative mode of coat-forming especially for structural parts or subassemblies of complicated shapes and are therefore particularly suitable for use in the construction of precision optical instruments. The invention further relates to a process for preparing such an electrolyte and a method of producing such conversion coatings.

A number of electrolytes have been proposed in the prior art for producing conversion coatings by means of spark discharge anodizing on light-weight materials, especially on valve metals such as titanium, tantalum, zirconium, niobium, or aluminum (cf. German Democratic Republic [GDR] Patents Nos. 229,163, 236,978, and 142,360, as well as European Patent No. 0 280 886). The electrolytes used here contain predominantly subgroup elements bonded as hydroxo, amino, or complexon complexes. For example, GDR Patent No. 229,163 describes electrolytic solutions for producing black or grayish black conversion coatings on light metals such as aluminum. These electrolytic solutions contain for the most part fluorides as NaF or $NH_4F$, dihydrogen phosphates such as $NaH_2PO_4$, tetraborates as borax $Na_2B_4O_7$, and chromates, as well as other foreign additives. One shortcoming is that the use of fluorides necessitates special working, environmental, and disposal precautions.

GDR Patent No. 257,275 refers to decorative coatings, among other things, on titanium materials, produced by means of the spark discharge anodizing method and an electrolyte consisting of NaF, $NaH_2PO_4$, $Na_2B_4O_7$, and potassium hexacyanoferrate $K_4Fe(CH)_6$. Besides the aforementioned shortcomings attributable to the fluoride content, this solution involves the great difficulties of health and environmental protection associated with the toxic effects of the cyanide-containing electrolyte. The black coloring is obtained merely through the use of the hexacyanoferrate, which forms a titanium spinel similar to the black iron-aluminum spinel and serves merely decorative purposes.

GDR Patent No. 236,978 describes solar-selective absorption coatings consisting of dark colored, chroma-doped oxide coatings on valve metals, such as titanium, tantalum, zirconium, niobium, and aluminum, which are likewise produced by means of spark discharge anodizing with a fluoridic electrolyte containing dihydrogen phosphate, tetraborate, and chromate. These electrolytes also have the aforementioned shortcoming of fluoride content, and the coatings obtained thereby furthermore have such a rough surface-structure effect that if they are used, e.g., as a functional surface for structural components or subassemblies of complicated shapes, there is such abrasion that accuracy to gauge no longer exists. Such coatings have a high absorption capacity $\alpha$; but again owing to the rough surface-structure effect, they show zig-zag reflections of the incident radiation which then transmits its energy to the absorption coating in the form of heat, and this heat is transferred to the collector body. A very low thermal emission $\epsilon$ is obtained in proportion to the optical absorption $\alpha$.

Electrolytes free of cyanides and fluorides, hence inoffensive to health and to the environment, have recently been proposed for producing finely matte-finished, deep black conversion coatings having nearly equal optical absorption and thermal emission capability on light metals or alloys thereof, obtained by means of spark discharge anodizing. The coatings thus produced are from 10–12 $\mu$m thick, guaranteeing a wide range of applications, but are not suitable as functional surfaces for structural components (e.g., fits, threads) having higher requirements for accuracy to gauge. Since the electrolyte consists, among other things, of a 2–6% ammoniacal solution by volume, a distinct malodorousness occurs which makes increased demands upon the production technology.

It is an object of this invention to provide an improved, easily handled electrolyte for producing uniformly thin, matte black conversion coatings as functional surfaces of structural components or subassemblies which open up a large structural scope even in the case of components and subassemblies of complicated shape.

A further object of this invention is to provide an electrolyte which is low in harmful substances and inoffensive to the environment.

Still another object of this invention is to provide an electrolyte which makes it possible to produce optically black coatings having a coating thickness of $<10$ $\mu$m and substantially equal optical absorption and thermal emission capability by means of spark discharge anodizing.

To this end, the electrolyte according to the present invention, of the type initially mentioned, comprises an aqueous solution of potassium dihydrogen phosphate, potassium chromate, acetate ions, ammonium citrate, and ethylene diamine.

In the process for preparing this electrolyte according to the present invention, from 0.4 to 0.7 moles/lt. of potassium dihydrogen phosphate, from 0.3 to 0.08 moles/lt. of potassium chromate, acetate ions in concentrations of from 0.08 to 0.5 moles/lt., from 0.1 to 0.3 moles/lt. of ammonium citrate, and from 0.5 to 0.9 moles/lt. of ethylene diamine are mixed to form an aqueous solution.

The method of producing thin, black conversion coatings according to the present invention comprises the step of coating light metal or alloys thereof by means of plasma- chemical anode treatment in an aqueous electrolyte comprising from 0.4 to 0.7 moles/lt. of potassium dihydrogen phosphate, from 0.3 to 0.08 moles/lt. of potassium chromate, acetate ions in concentrations of from 0.08 to 0.5 moles/lt., from 0.1 to 0.3 moles/lt. of ammonium citrate, and from 0.5 to 0.9 moles/lt. of ethylene diamine at a current density of from 0.005 to 0.05 A $cm^{-2}$ and a voltage of from 100 to 200V.

The main advantages of the inventive solution are an electrolyte which

- makes it possible to produce optically black coatings having a thickness of less than 10 microns and substantially equal optical absorption and thermal emission capability,
- is free of ammonia, cyanide, and fluoride and is therefore inoffensive to health and the environment, i.e., no additional measures are necessary for the protection of personnel and the environment, yields, when used in spark discharge anodizing, a conversion coating having a substantially lower roughness factor and hence lower particle generation as compared with prior art conversion coatings obtained by spark discharge anodizing, through its utilization in spark discharge anodizing presents, therefore, an alternative coat-forming method for structural components or subassemblies of complicated shapes having higher requirements for accuracy to gauge, and produces a coating system making possible very good thermovacuum stability combined with high long-term stability through minimal generation of volatile components of the coating system. Contamination phenomena which impair performance in subassemblies, e.g., in optical systems, are thereby excluded.

A preferred embodiment of the invention will now be described in detail with reference to the following example.

A degreased and alkaline-pickled sheet of AlMg 5 was connected as an anode in an electrolysis bath consisting of an aqueous solution of 0.59 moles/lt. = 80 g/lt. of $KH_2PO_4$, 0.05 moles/lt. = 10 g/lt. of $K_2CrO_4$, 0.35 moles/lt. = 70 g/lt. of $Cu[CH_3COO]_2.H_2O$, 0.22 moles/lt. = 50 g/lt. of $NH_4$.citrate, and 0.38 moles/lt. = 100 ml of ethylene diamine and was coated with the aid of spark discharge anodizing at a current density of $0.05 A.cm^{-2}$ and at a voltage of 170V. A deep black, matte conversion coating was obtained.

In comparison thereto, a likewise degreased and alkaline-pickled sheet of AlMg 5 was coated by means of plasma-chemical spark discharge anodizing in a prior art aqueous electrolyte consisting of a 4.5% by volume ammoniacal solution with 0.5 moles/lt. of $KH_2PO_4$, 0.1 moles/lt. of $K_2CrO_4$, and 0.35 moles/lt. of $Cu[CH_3COO]_2$ at a current density of $0.045 A.cm^{-2}$.

A deep black-colored conversion coating was obtained also in the single-stage process.

The significant differences between the two solutions are shown in Table 1.

TABLE 1

| Parameter | Prior Art Electrolyte | Inventive Electrolyte |
|---|---|---|
| Coating characterization: | | |
| Coating thickness in μm ±0.5 | 12.0 ± 3 | 3.8 |
| Roughness factor in μm ±0.1 | 3.7 ± 0.1 | 1.8 |
| Remission in % | 6.9 | 6.0 |
| Breakdown strength in V | 520 | 800 |
| Aftertreatment | Washing with NH3 Solution | Washing with Water |
| Preferred possibilities of application: | AlMg 3<br>AlMg 5<br>AlMg 1 Si 1 Mn<br><br><br>EMO-Ti | AlMg 3<br>AlMg 5<br>AlMg 1 Si 1 Mn<br>AlCu 4 Si 1<br>G-AlSi 10 Mg<br>EMO-Ti |

It may be gathered that with the novel electrolyte, a conversion coating having a thickness of app. 4 microns is obtained. It is thus about 30% of the coating thickness of conventional black spark discharge anodized coatings. This is advantageous especially for structural solutions in which coating must take place without modification of the fit tolerance. Thus, even thread fits of up to H6 tolerances can be controlled. The release of particles during fitting of parts is minimized. The good scattering power of the electrolyte also makes possible the interior coating of cylindrical parts up to an inside diameter-to-length ratio of 1:10.

The remission at 540 nm is 6%, hence comparable with prior art black spark discharge anodizing coatings.

The roughness ($R_z$) roughness factor is 1.6 microns, whereas for conventional black spark discharge anodized coatings it is 5.4 microns, with the same starting roughness of 0.7 microns. Hence the coatings obtained have less particle generation and are therefore suitable as an alternative mode of coat-forming for structural components or subassemblies of complicated shapes having higher requirements for accuracy to gauge.

Testing of the breakdown strength is to be understood here as a laboratory method of determining the current/potential gradient up to breakdown of the coating under high-vacuum conditions ($10^{-2}$ Pa). The results show that with decreasing thickness of the coating, the breakdown strength is maintained or even somewhat increased owing to the specific morphology of the coating. It would have been supposed, however, that in the case of coatings of chemically similar composition, the breakdown strength would lessen with decreasing thickness of the coating (cf. *Elektrische Isoliertechnik*, by M. Kahle, published by VEB Verlag Technik, Berlin (1988).

Furthermore, no malodorousness of any kind occurs during the coating process through the use of a non-ammoniacal electrolyte. Subsequent rinsing with an ammoniacal aqueous solution is superfluous.

What is claimed is:

1. An electrolyte for producing thin, black conversion coatings on light metals or alloys thereof by means of spark discharge anodizing, comprising potassium dihydrogen phosphate, potassium chromate, acetate ions, ammonium citrate, and ethylene diamine in aqueous solution.

2. A process for preparing an electrolyte intended to be used in producing thin, black conversion coatings on light metals or alloys thereof by means of spark discharge anodizing, wherein from 0.4 to 0.7 moles/lt. of potassium dihydrogen phosphate, from 0.3 to 0.08 moles/lt. of potassium chromate, acetate ions in concentrations of from 0.08 to 0.5 moles/lt., from 0.1 to 0.3 moles/lt. of ammonium citrate, and from 0.5 to 0.9 moles/lt. of ethylene diamine are mixed to form an aqueous solution.

3. The process of claim 2, wherein the acetate ions are acetate ions of copper acetate.

4. A method of producing thin, black conversion coatings comprising the step of coating light metal or alloys thereof by means of plasma-chemical anode treatment in an aqueous electrolyte comprising from 0.4 to 0.7 moles/lt. of potassium dihydrogen phosphate, from 0.3 to 0.08 moles/lt. of potassium chromate, acetate ions in concentrations of from 0.08 to 0.5 moles/lt., from 0.1 to 0.3 moles/lt. of ammonium citrate, and from 0.5 to 0.9 moles/lt. of ethylene diamine at a current density of from 0.005 to 0.05 A $cm^{-2}$ and a voltage of from 100 to 200V.

* * * * *